US006010089A

United States Patent [19]

Winafeld et al.

[11] Patent Number: 6,010,089

[45] Date of Patent: Jan. 4, 2000

[54] TENSION CONTROL DEVICE

[75] Inventors: Charles J. Winafeld, North Canton; Raymond J. Slezak, Barberton, both of Ohio

[73] Assignee: RJS Corporation, Akron, Ohio

[21] Appl. No.: 09/151,472

[22] Filed: Sep. 11, 1998

[51] Int. Cl.[7] ..... B65H 23/06; B65H 59/38; B65H 59/40

[52] U.S. Cl. ..... 242/421.8; 242/156.2; 242/148

[58] Field of Search ..... 242/421, 421.8, 242/156.2, 421.5, 421.6, 421.7, 421.9, 156, 148

[56] References Cited

U.S. PATENT DOCUMENTS

| | | | |
|---|---|---|---|
| 724,975 | 4/1903 | Wardwell . | |
| 847,393 | 3/1907 | Ballard | 242/421.8 |
| 1,031,487 | 7/1912 | Taylor . | |
| 1,100,039 | 6/1914 | Tyler et al. . | |
| 1,462,604 | 7/1923 | Lavalle . | |
| 1,475,855 | 11/1923 | Murdock . | |
| 1,946,313 | 2/1934 | Daniels | 242/156 |
| 2,472,548 | 6/1949 | Schnell | 242/421.6 |
| 2,766,945 | 10/1956 | Reich | 242/421.1 |
| 2,879,011 | 3/1959 | Nelson | 242/156.2 |
| 2,983,468 | 5/1961 | Perrella | 242/156.2 |
| 3,069,107 | 12/1962 | Hirt | 242/421.8 |
| 3,076,618 | 2/1963 | Van Hook | 242/421.8 |
| 3,081,957 | 3/1963 | Van De Bilt | 242/420 |
| 3,223,352 | 12/1965 | Fuller et al. | 242/156.2 |
| 3,355,122 | 11/1967 | Thatcher | 242/421.9 |
| 3,446,452 | 5/1969 | Tetens | 242/421.8 X |
| 3,699,809 | 10/1972 | Komatsu | 242/421 X |
| 3,731,889 | 5/1973 | Alexeff | 242/156.2 |
| 3,899,143 | 8/1975 | Slezak | 242/156.2 |

*Primary Examiner*—Donald P. Walsh
*Assistant Examiner*—Collin A. Webb
*Attorney, Agent, or Firm*—Renner, Kenner, Greive, Bobak, Taylor & Weber

[57] ABSTRACT

A tension control device (10 for tensioning filamentary material (F) being withdrawn from a spool (24) including, a mounting support (11), a spindle (24) receiving the spool and rotatably mounted relative to the mounting support, a control arm (13) rotatably mounted on a shaft (15) in operative relation to the spindle, a brake element (18) mounted on the control arm for selectively retarding rotation of the spindle, a guide roller (16) rotatably attached to the control arm over which the filamentary material being withdrawn from the spool is passed, and a break-away mounted (80) of the guide roller to provide tension relief when the tension in the filamentary material exceeds a predetermined value. A break-away signaling system (95) detects and signals angular movement of the guide roller relative to the control arm.

17 Claims, 5 Drawing Sheets

TENSION CONTROL DEVICE

TECHNICAL FIELD

The present invention relates generally to a tension control device for regulating the amount of tension in a filamentary material as it is being withdrawn from a spool. More particularly, the present invention relates to a tension control device for cord material having a tension relief mechanism to prevent damage to the control arm of the device when cord tension exceeds the working range of the device and before damage to the control arm can result. More specifically, the present invention relates to a tension control device for cord material having a control arm with a cord-engaging guide roller pivotally mounted on the lever for break-away tension relief to preclude control arm damage when cord tension overload occurs.

BACKGROUND ART

Tension control devices for regulating the withdrawal of filamentary material from a spool have been known for a number of years. Filamentary materials include single- and multiple-strand fibers produced in long lengths and conveniently wound on spools to facilitate handling. Filamentary materials are variously made of natural or synthetic fibers, glass, or metal. Such materials in the form of filaments are commonly utilized as reinforcing members for plastic or elastomeric compounds, or the materials themselves may be fabricated into integral items, as is done in the textile industry. In most applications, it is advantageous to withdraw the filamentary material from the spool at or near the location it is being used in a manufacturing process. To facilitate such withdrawal, a spool is customarily mounted on a spindle, which may be mounted on a creel assembly as one of a plurality of spindles carrying spools, which permit the spools to rotate as the filament is withdrawn, normally simultaneously from a plurality of spools.

The payout of the filamentary material from the spool may be at a high linear velocity, thereby imparting substantial momentum to the spool and related spindle. As a result, it is necessary to dissipate force rapidly in the event the filamentary material breaks or take-up force suddenly decreases or stops. In such situation, filamentary material continues to be payed out more rapidly than it is needed or desired until rotation of the spool can be appropriately slowed or retarded. The presence of excessive slack in the filamentary material can produce twisting of the filamentary material or interference with associated machinery or other spools, particularly where a great number of spools are continuously operating in close proximity, as when mounted on a creel assembly.

In order to compensate for excessive payout of filamentary material in the event of a break in the filamentary material or a sudden decrease in the take-up, braking devices have been developed for use with creels. In such devices, as the tension decreases, producing slack in the filamentary material, a breaking force is applied to slow the rotation of the spool. Features required in such breaking or tension control devices are the capability of varying the amount of tension in the filamentary material; a simple, single adjustment to provide a desired tension; the absence of the necessity to adjust tension as the spool is emptied, and a configuration that eliminates undesirable hunting or loping in the form of periodic variations in tension about a desired tension setting. These requirements have been satisfied by a tension control device for spools pursuant to Applicant's Assignee's U.S. Pat. No. 3,899,143.

In addition to the above-described instances where tension in the filamentary material suddenly decreases, there are also instances in the operation of spool payout where the tension suddenly greatly increases. Such increases in tension may be caused by a snag in the filamentary material at the spool, an overlap or other miswinding of the filamentary material, mechanical interference with the rotation of the spool, or other reasons. As can be appreciated, a snag or the like can provide an abrupt and severe tension increase in the filamentary material exceeding the design range of the tension controller. In the event of the usage of a roller paralleling the spool axis mounted on a control arm as an operative element of a tension control device, such a tension overload in the filamentary material can cause the control arm roller to put a bending moment or torsional load on the control arm, which can break or permanently deform the control arm and/or the roller, thereby rendering the tension control device inoperable until replacement parts are obtained and installed. Where payout velocities of the filamentary material are extremely high and the filamentary material is in the form of steel cords, it is apparent that sudden tension overloads can readily be destructive of even a control arm configuration designed to withstand several times the forces encountered in the normal working range of the tension controller.

DISCLOSURE OF THE INVENTION

Therefore, an object ofthe present invention is to provide a tension control device for filamentary material that can withstand sudden increases in tension in the filamentary material, which greatly exceed the design working range of the tension controller without breaking or permanently deforming the control arm or otherwise making the tension controller inoperable. Another object ofthe present invention is to provide such a tension controller that can withstand such instantaneous increases in the tension in the filamentary material without affecting the operation of the tension control device in its designed working range. Yet another object of the present invention is to provide such a tension control device that permits a change in the payout path of the filamentary material upon the occasion of a tension increase beyond its working range so that the control arm is relieved of inordinate stress that would otherwise be imparted by the filamentary material.

Another object of the present invention is to provide a tension control device for filamentary material that is particularly adaptable to devices that employ a control arm mounting a guide roller that engages the filamentary material and controls the withdrawal of the filamentary material at a regulated tension by virtue of its operative interrelationship with a breaking element that engages a spindle mounting a spool carrying the filamentary material. Still another object of the present invention is to provide such a tension control device having a break-away control arm that relieves tension in the guide roller and control arm in the event the filamentary material experiences an increase in tension beyond the designed working range of the tension control device but before damage to the tension control device can occur. Yet a further object of the present invention is to provide such a tension control device wherein the control arm roller is pivotally mounted relative to the control arm, such as to permit the guide roller to pivot in the direction of payout of the filamentary material when the filamentary material experiences a tension overload. Still another object of the present invention is to provide such a tension control device wherein the pivotal motion of the guide roller relative to the control arm is spring loaded to permit selective adjustment of the break-away force required.

Yet a further object of the present invention is to provide a tension control device for filamentary material that, after break-away, may be readily restored to operating condition once the source of the tension overload in the filamentary material has been rectified, thus preventing damage to the roller and control arm. Still another object of the present invention is to provide such a tension control device that may be readily adjusted from the break-away position occasioned by a tension overload in the filamentary material to the normal operating position by a quick and easy manual adjustment of the position of the roller relative to the control arm, thereby effecting quick resumption of a manufacturing process employing the filamentary material. Still a further object of the present invention is to provide such a tension control device that may readily incorporate a sensor to detect the overload condition and supply a signal to a remote location where the status of a plurality of such devices may be monitored to permit prompt correction of break-away actuation of the guide roller.

Yet a further object of the present invention is to provide a tension control device for filamentary material that may employ a break-away feature according to the present invention that may be employed in a creel or other arrangement with other tension control devices in relatively close proximity without interference with other proximate tension control devices when the break-away control arm is actuated in operation due to a tension overload in the filamentary material. Still a further object of the present invention is to provide such a tension control device having a break-away control arm that does not adversely affect any of the operating parameters of the basic tension control device, except during the presence of a tension overload in the filamentary material. Still another object of the present invention is to provide such a tension control device that may be retrofit on existing tension control devices in the field merely by replacement of the tension control arm assembly. Still another object of the present invention is to provide such a tension control device that is relatively non-complex, inexpensive, and maintenance-free, while eliminating the potential for damage to the device from an operating condition otherwise capable of imparting significant damage to the device.

In general, the present invention contemplates a tension control device for tensioning filamentary material being withdrawn from a spool including, a mounting support, a spindle receiving the spool and rotatably mounted relative to the mounting support, a control arm rotatably mounted on a shaft in operative relation to the spindle, a brake element mounted on the control arm for selectively retarding rotation of the spindle, a guide roller rotatably attached to the control arm over which the filamentary material being withdrawn from the spool is passed, and a break-away mounted of the guide roller to provide tension relief when the tension in the filamentary material exceeds a predetermined value.

PREFERRED EMBODIMENT FOR CARRYING OUT THE INVENTION

Figure 1:
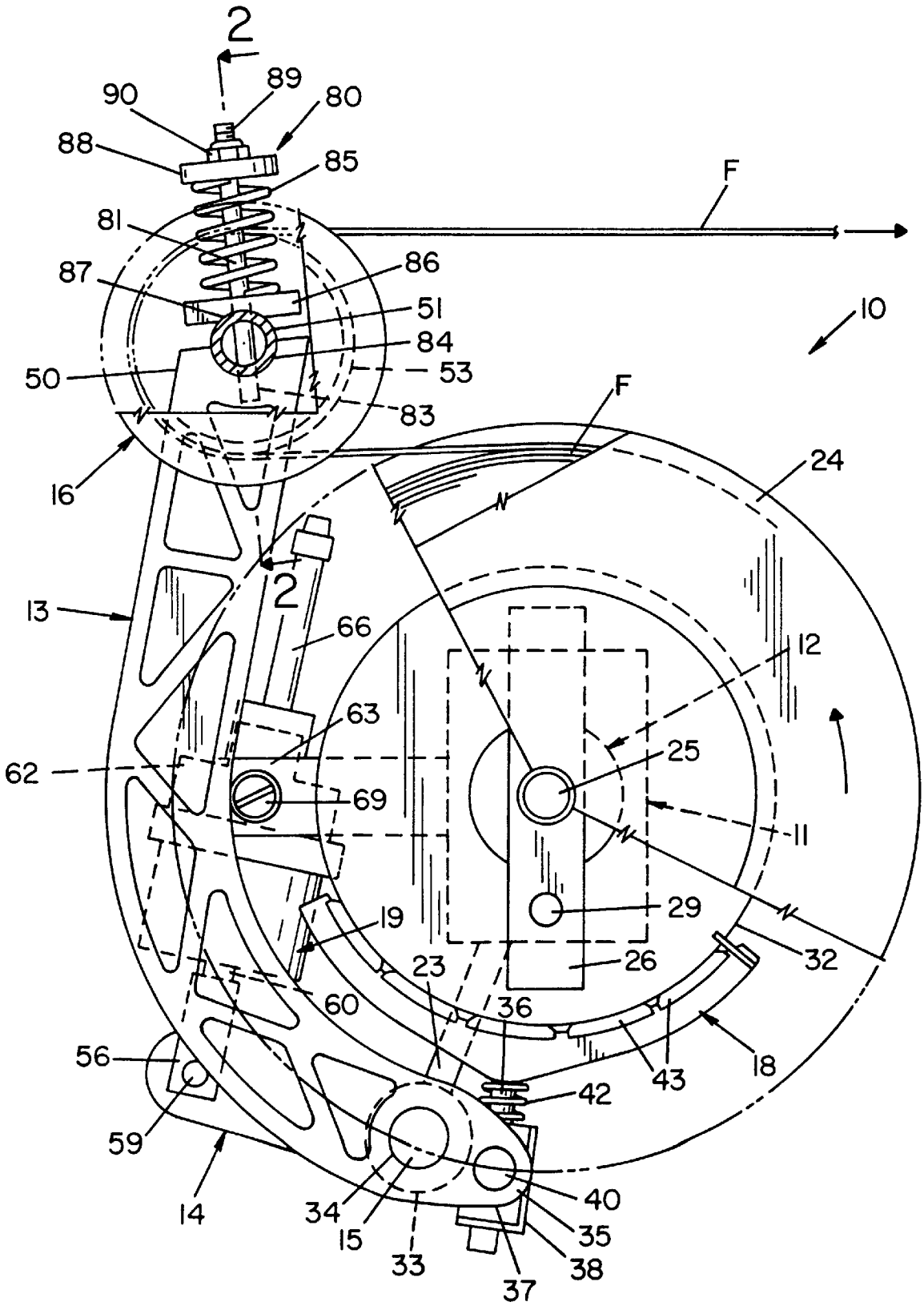
FIG. 1 is a side-elevation view of a tension control device having an exemplary break-away control arm according to the concepts of the present invention shown in the normal operating position.

The basic tension control device, indicated generally by the numeral 10 in FIG. 1 of the drawings, constitutes an exemplary apparatus in which a tension relief mechanism, generally indicated by the numeral 80, may be embodied. The basic tension control device 10 is described only in sufficient detail for an understanding of the present invention. Applicant's Assignee's U.S. Pat. No. 3,899,143 entitled "Tension Control Device" is incorporated herewith by reference with respect to structural details and operating parameters of the basic tension control device 10.

Figure 2:
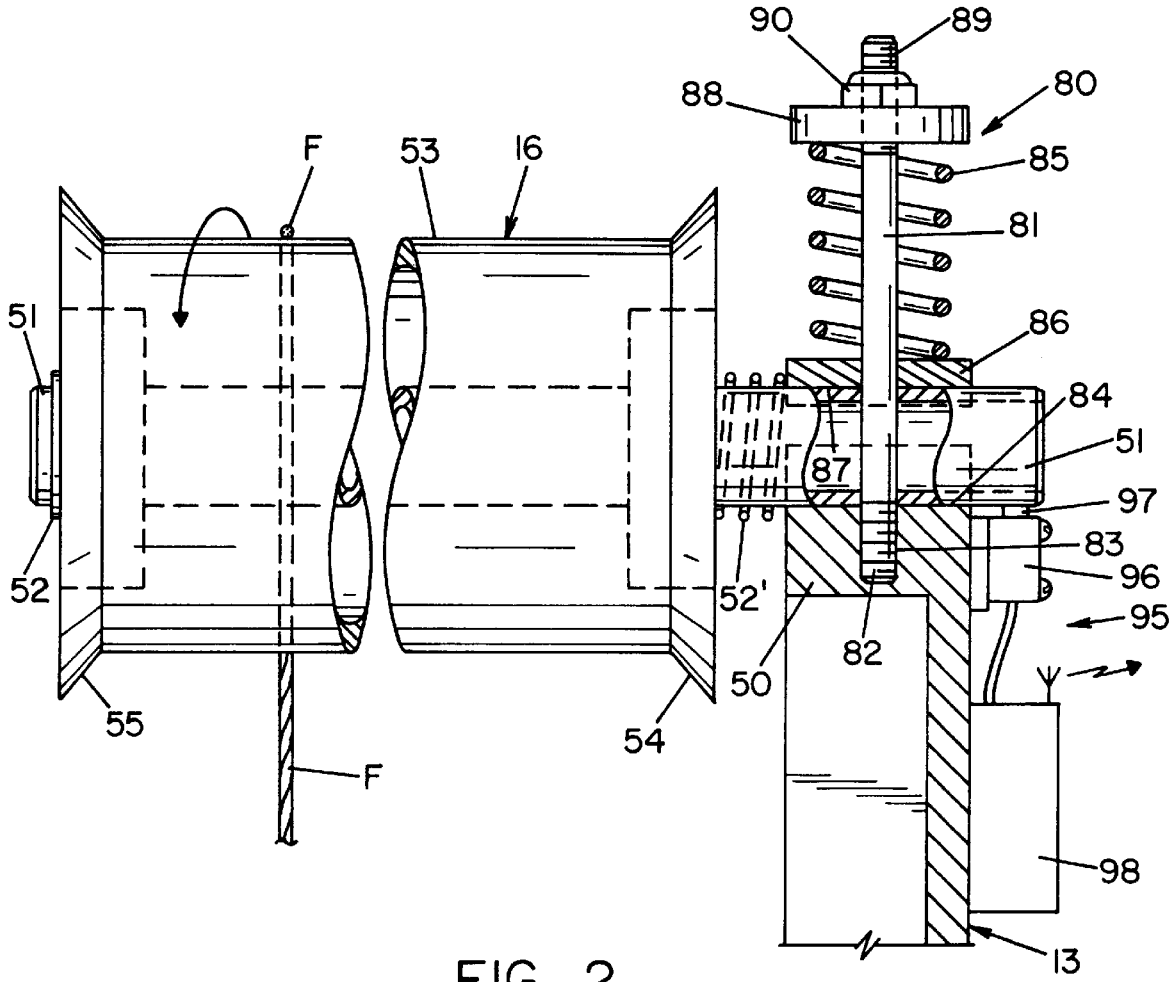
FIG. 2 is an enlarged, front-elevation view, partially in section, of the break-away control arm of FIG. 1.

Referring particularly to FIGS. 1 and 2 of the drawings, the tension control device 10 has a spool support, generally indicated by the numeral 12, attached to a support structure 11. A pair of levers in the form of a control arm, generally indicated by the numeral 13, and a torsional biasing arm, generally indicated by the numeral 14, are fixed on a pivot shaft 15. The control arm 13 carries a guide roller 16 and a brake shoe 18. The torsional biasing arm 14 is connected to a cylinder 19.

The spool support 12 includes a spindle 25 that is rotatably mounted and is of a suitable length and diameter so as to pass through the center of a spool 24 carrying the filamentary material F that is to be payed out under a preselected, uniform tension. Mounted on the spindle 25 and rotatable therewith is a spacer bar 26 that carries at least one drive pin 29. The drive pin 29 is engageable with a bore in the spool 24, whereby the spacer bar 26, spindle 25 and spool 24 rotate as a unit when a remote takeoff withdraws filamentary material F from the spool 24. Attached to the spindle 25 is a circumferential brake drum 32 that is engaged by the brake shoe 18 of control arm 13 to produce the desired braking operation in response to changes in tension occurring with variances in the rate of take-up of the filamentary material F.

Attached to the end portion of a fixed arm 23 is a cylindrical housing 33 that freely rotatably mounts the shaft 15. The outboard end of shaft 15 carries the control arm 13, which has a bore 34 for receipt of the shaft 15. As best seen in FIG. 1, the control arm 13 is pivotable toward and away from the spindle 25 and spool 24. The elongate control lever 13 terminates a short distance beyond its connection with the shaft 15 in an end 37 having a clevis 35. The brake shoe 18 is supported by a cylindrical stem 36 having a block 38 that is received by the clevis 35. A pin 40 passes through the clevis 35 and the block 38 permitting a limited amount of pivotal movement therebetween as the control arm 13 pivots about the shaft 15. A compression spring 42 encircles the stem 36 and is interposed between the block 38 and the brake shoe 18 to resiliently bias the brake shoe 18 toward the braking surface 32 to provide a graduated or cushioned application and release of braking force. This reduces and tends to render more uniform the response sensitivity of the brake surface 32 to the pivotal movement of lever 13. The brake shoe 18 is provided with a suitable lining 43 that engages the braking surface 32 on the brake drum 32.

The opposite end 50 of the control lever 13 from the end 37 carrying the brake shoe 18 is the guide roller 16 rotatably mounted on a shaft 51 extending substantially perpendicularly from the lever 13 and generally parallel with the spindle 25 and the axis of the spool 24. A removable collar 52 maintains the guide roller 16 on the shaft 51 with a spring 52' interposed between the control lever 13 and guide roller 16. Guide roller 16 preferably includes a smooth, cylindrical metal surface 53 over which the filamentary material F passes. As the filamentary material F is payed out from the spool 24 and passes over the surface 53, it is maintained within the confines of the surface 53 by lateral flanges 54 and 55 on the guide roller 16. The guide roller 16 is preferably dimensioned so that the surface 53 is as long as the width of a spool 24, as seen mounted on spindle 25 in FIG. 1 of the drawings, to ensure the smooth and uniform withdrawal of filamentary material F from the spool 24 without fouling or disengagement.

The torsional biasing arm 14 is secured at one end on the end board end of shaft 15, with the levers 13 and 14 and the shaft 15 being pivotable with respect to the cylindrical housing 33. At the opposite end of the lever 14 from the shaft 15, a yoke 56 is affixed as by a pin 59. The upper end of yoke 56 is connected to a piston rod 60 that extends from cylinder 19. The blind end of cylinder 19 is attached to a fixed, angled support brace 63 as by a fastener 69. The cylinder 19 receives a fluid supply at its upper end via a conduit 66 connected to a suitable source of supply (not shown).

Figure 3:
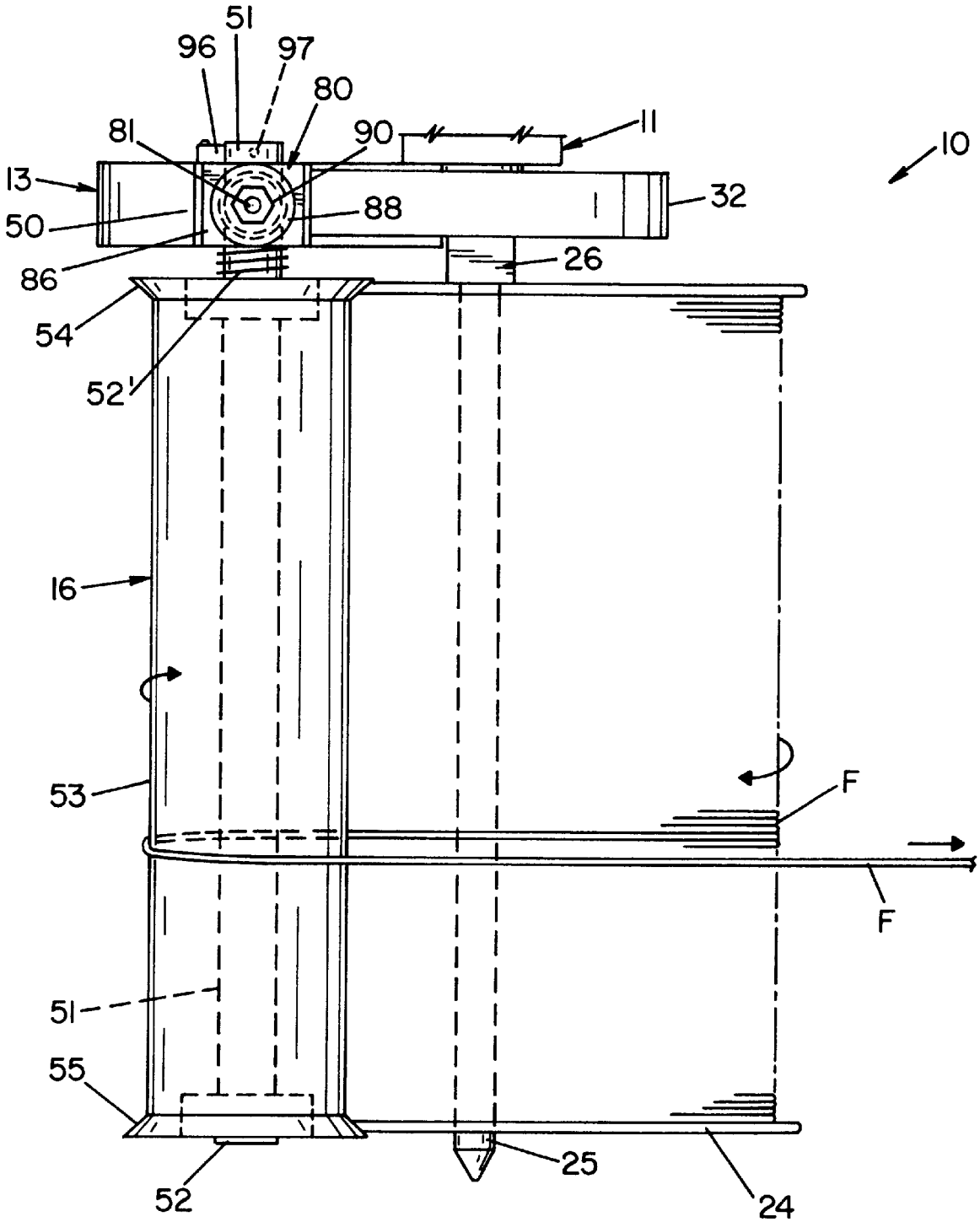
FIG. 3 is a top-plan view of the break-away control arm of FIG. 1.

The tension relief mechanism 80 interconnects the end 50 of the control lever 13 with the guide roller 16. Referring particularly to FIGS. 2–5, the tension relief mechanism 80 is defined by the interrelation between the shaft 51 of guide roller 16 and the end 50 of the control arm 13. The shaft 51 is attached to control arm 13 by a stud 81, which extends through shaft 51 into end 50 of control arm 13. One end of stud 81 has threads 82 (FIG. 2) that matingly engage a tapped bore 83 in the end 50 of control arm 13. The end 50 of control arm 13 has a detent 84 (see particularly FIGS. 1 and 5), which is a curved indentation constituting a portion of a circle having a radius substantially equal to the radius of the shaft 51. As seen in FIGS. 1, 2, and 3, the shaft 51 reposes in and is coincident with the detent 84 when the tension control device 10 is in the normal operating position.

The shaft 51 is pivotally mounted on the stud 81 of tension relief mechanism 80 to produce a breakaway mounting of guide roller 16 to effect tension relief in the filamentary material F. Pivotal movement of the shaft 51 is resisted during normal operation of tension control device 10 by a compression spring 85, which surrounds the stud 81 and acts to bias shaft 51 into the detent 84 in the control arm 13. To facilitate the application of force to the shaft 51 by compression spring 85, one end of compression spring 85 engages a lower spring perch 86 to force it into engagement with the shaft 51. The lower spring perch 86 may have a curved notch 87 that receives the shaft 51, such that the spring perch 86 rotates on stud 81 with the shaft 51 and relative to spring 85. An upper spring perch is carried on the stud 81 at the other end of the compression spring 85. Thus, the compression spring 85 is interposed between the spring perches 86, 88 and applies force to seat shaft 51 in the detent 84. The extremity of the stud 81 opposite the threads 82 is provided with threads 89 to receive a nut 90 that upwardly abuts the upper spring perch 88 to maintain upper spring perch 88 at a desired position along the stud 81 to maintain a preselected uniform pressure of spring 85 on the shaft 51. The nut 90 is advantageously a locknut so as to retain a preset position along the threads 89 of stud 81 despite intermittent pivoting of shaft 51 relative to control arm 13. It will be appreciated that adjustment of the nut 90 axially of the stud 81 serves to selectively pretension compression spring 85 and the force acting on shaft 51 to maintain it in the detent 84 of control arm 13.

If desired, the tension control device may be provided with a breakaway signaling system, generally indicated by the numeral 95, as best seen in FIG. 2 of the drawings, which is designed to monitor the position of the guide roller 16 relative to the control arm 13. As shown, the breakaway signaling system consists of a limit switch 96 mounted on said control arm 13 and having a contact button 97 that is depressed when the shaft 51 is in the normal operating position depicted in FIG. 2. The button 97 is released when the shaft 51 angularly pivots on stud 81 to indicate or detect a breakaway condition. At such time, the limit switch 96 may supply a signal to actuate a transmitter 98 that communicates with a remote receiver (not shown), which may in turn produce an audio or video signal, or both, for purposes of remotely signaling a breakaway condition of guide roller 16 relative to control arm 13. It will be appreciated that in lieu of switch 96, photoelectric or other types of sensors could be employed to signal the position of guide roller 16. The utilization of a breakaway signaling system 95 is particularly significant in instances where a plurality of tension control devices 10 are being employed, as on a creel arrangement, to promptly detect and locate the actuation of a tension relief mechanism 80 from its normal operating position. The signal transmitted to a remote receiver may be coded to uniquely identify signals from a plurality of tension control devices 10. Additionally, breakaway signaling system 95 may be advantageously employed where a tension control device 10 is not continuously monitored.

The operation of the basic tension control device 10 remains essentially as described in Applicant's Assignee's U.S. Pat. No. 3,899,143, except for the tension relief mechanism 80, the set up and operation of which will be largely apparent to persons skilled in the art, based upon the foregoing description. Initially, the tension relief mechanism 80 is adjusted by movement of the locknut axially of the stud 81 to a preselected compression of the spring 85, which corresponds to a tension in the filamentary material F, at which it is desired that the shaft 51 pivot about control arm 13 in order to preclude damage to the control arm 13, guide roller 16, or associated structure of the tension control device 10. The tension control device 10 is then operated in conventional fashion, with filamentary material F being payed off or withdrawn from a spool 24 via the guide roller 16 to a takeaway device employing the filamentary material F. The tension relief mechanism remains in its normal operating condition depicted in FIGS. 1–3 as long as the tension in the filamentary material F remains within the working range of the tension control device 10.

Figure 4:
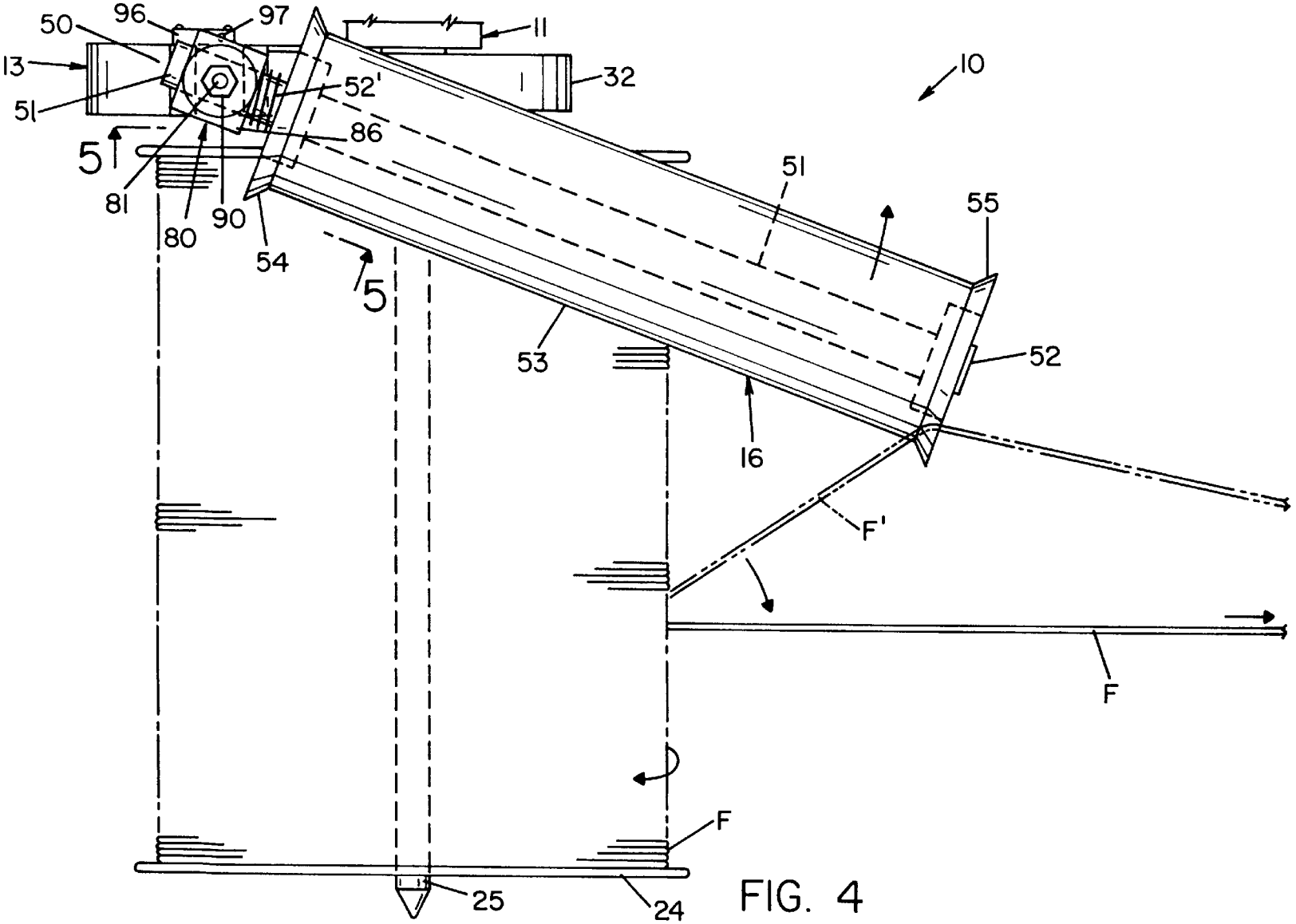
FIG. 4 is a top-plan view of the break-away control arm, similar to FIG. 3, showing the guide roller of the control arm in the angularly displaced break-away position.
Figure 5:
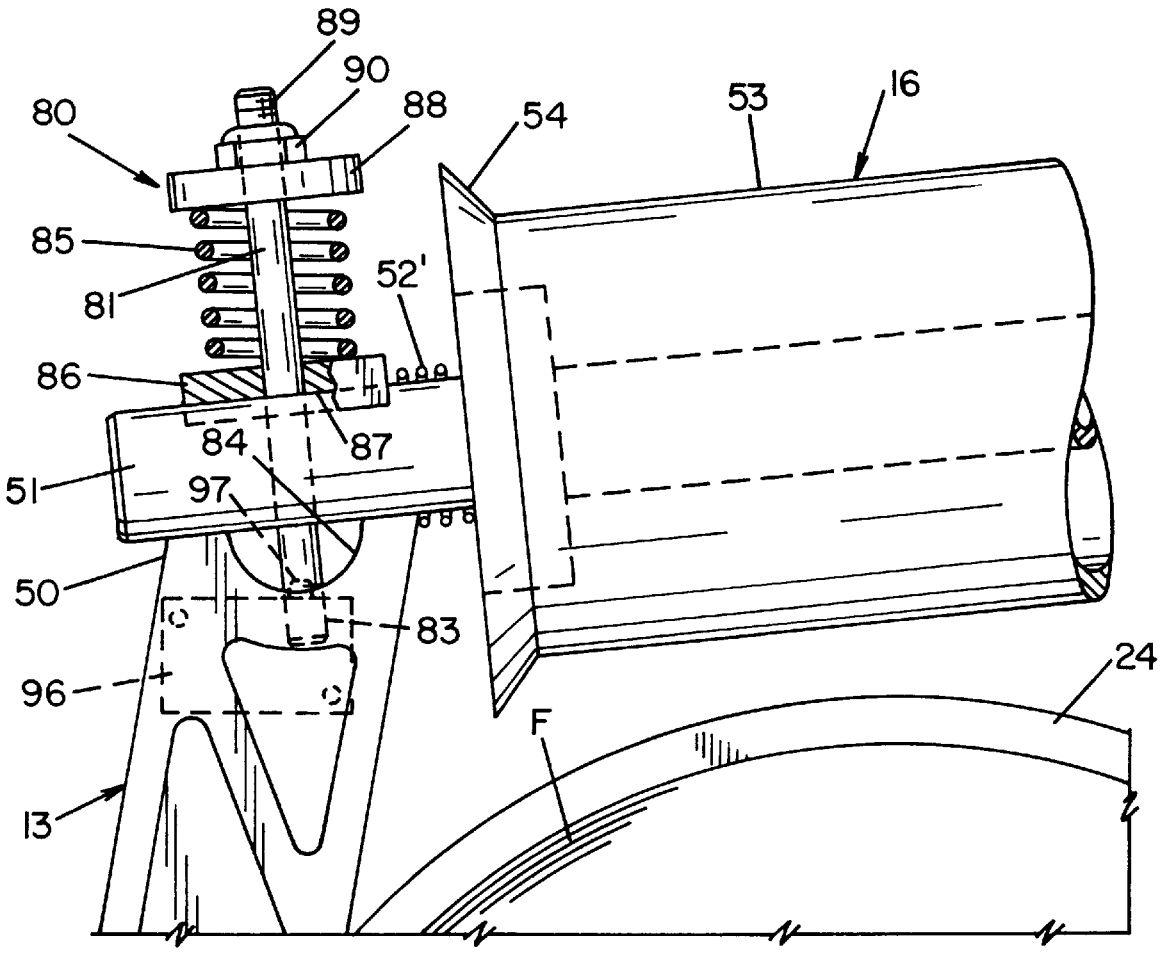
FIG. 5 is an enlarged, fragmentary view of the break-away arm, taken substantially along the line 5—5 of FIG. 4, showing details of the interconnection between the lever and the guide roller.

However, in the event of a snag or other problem wherein the tension in filamentary material F exceeds a predetermined level dictated by the setting of compression spring 85, the guide roller 16 rotates about the stud 81, with the shaft 51 compressing spring 85 and moving out of the detent 84 to pivot in the direction of takeoff of filamentary material F so that the filamentary material F may slide along the surface 53 of guide roller 16 to the F' position depicted in FIG. 4 and subsequently be released from the guide roller 16. As seen in FIGS. 4 and 5, the pivoting of the guide roller 16 with attendant reduction of tension in the filamentary material prevents damage to the control arm 13 or guide roller 16. Once the pickup of filamentary material M is stopped, as by visually noting the positioning of guide roller 16 or an output of the breakaway signaling system 95, the snag or other reason for the tension overload may be corrected. Thereafter, the guide roller 16 may be manually grasped and returned to the normal operating position depicted in FIGS. 1–3 of the drawings. The filamentary material F is then reeved about the guide roller 16 and normal operation of the tension control device 10 may be resumed.

Thus, it should be evident that the disclosed tension control device carries out the objects of the invention set forth above. As apparent to those skilled in the art, modifications can be made without the departing from the spirit of the invention herein disclosed and described, the scope of the invention being limited solely by the scope of the attached claims.

We claim:

1. A tension control device for tensioning filamentary material being withdrawn from a spool comprising, a mounting support, a spindle receiving the spool and rotatably mounted relative to said mounting support, a control arm rotatably mounted on a shaft in operative relation to said spindle, a brake element on said control arm for selectively retarding rotation of said spindle, a guide roller rotatably attached to said control arm over which the filamentary material being withdrawn from the spool is passed, and a break-away mounting of said guide roller to provide tension relief when the tension in the filamentary material exceeds a predetermined value.

2. A tension control device according to claim 1, wherein said break-away mounting is a pivotal interconnection between said guide roller and said control arm.

3. A tension control device according to claim 2, wherein said guide roller has a shaft that normally engages a detent in said control arm.

4. A tension control device according to claim 3, wherein said shaft of said guide roller is spring-biased into engagement with said detent in said control arm.

5. A tension control device according to claim 3, wherein a stud interconnects said shaft of said guide roller and said control arm.

6. A tension control device according to claim 5, wherein a spring is positioned on said stud interposed between a first spring perch engaging said shaft of said guide roller and a second spring perch engaging a stop nut on said stud, whereby said shaft of said guide roller is biased into engagement with said detent in said control arm.

7. A tension control device according to claim 6, wherein said first spring perch has a notch for engaging said shaft of said guide roller.

8. A tension control device according to claim 6, wherein said stop nut is movable axially of said stud to vary the force biasing said shaft of said guide roller into said detent in said control arm.

9. A tension control device according to claim 8, wherein said stop nut is a locknut that maintains its position axially of said stud during operation of said break-away mounting.

10. A tension relief mechanism for a tension control device for filamentary material being withdrawn from a spool comprising, a mounting support, a spindle receiving the spool and rotatably mounted relative to said mounting support, a control arm rotatably mounted on a shaft in operative relation to said spindle, a brake element on said control arm for selectively retarding rotation of said spindle, a guide roller rotatably attached to said control arm over which the filamentary material being withdrawn from the spool is passed, and tension relief means interconnecting said guide roller and said control arm to provide break-away release when the tension in the filamentary material exceeds a predetermined value.

11. A tension relief mechanism according to claim 10, wherein said tension relief means has a pivotal interconnection between said guide roller and said control arm.

12. A tension relief mechanism according to claim 11, wherein said tension relief means has a guide roller shaft that engages a detent in said control arm.

13. A tension relief mechanism according to claim 12, wherein said guide roller shaft is spring-biased into engagement with said detent in said control arm.

14. A tension relief mechanism according to claim 12, wherein a stud interconnects said guide roller shaft and said control arm.

15. A tension control device for tensioning filamentary material being withdrawn from a spool comprising, a fixed mount, a spindle receiving the spool and rotatably mounted relative to said fixed mount, a control arm mounted in operative relation to said spindle, a brake element on said control arm for selectively retarding rotation of said spindle, a guide roller rotatably attached to said control arm over which the filamentary material being withdrawn from the spool is passed, and a break-away mounting of said guide roller to provide tension relief to the filamentary material when actuated, and a break-away signaling system for detecting break-away of said guide roller relative to said control arm.

16. A tension control device according to claim 15, wherein said breakaway signaling system includes a limit switch for detecting movement of said guide roller relative to said control arm.

17. A tension control device according to claim 16, wherein said break-away signaling system includes a transmitter actuated by said limit switch to communicate with a remote receiver.

* * * * *